US006557288B2

(12) United States Patent
Szabo

(10) Patent No.: US 6,557,288 B2
(45) Date of Patent: May 6, 2003

(54) COMPACT GOVERNMENT MODEL HANDGUN

(76) Inventor: Attila Szabo, 1 Concorde Place, Toronto, Ontario (CA), PH1 M3C3K6

( * ) Notice: Subject to any disclaimer, the term of this patent is extended or adjusted under 35 U.S.C. 154(b) by 0 days.

(21) Appl. No.: 10/001,292

(22) Filed: Nov. 30, 2001

(65) Prior Publication Data

US 2002/0104248 A1 Aug. 8, 2002

Related U.S. Application Data

(60) Provisional application No. 60/250,463, filed on Dec. 4, 2000.

(51) Int. Cl.[7] ..... F41A 17/26
(52) U.S. Cl. ..... 42/70.01; 42/69.03; 42/70.08
(58) Field of Search ..... 42/70.01, 70.08, 42/69.03; 89/142, 148, 154

(56) References Cited

U.S. PATENT DOCUMENTS

| | | | | | |
|---|---|---|---|---|---|
| 984,519 | A | | 2/1911 | Browning | |
| 1,070,582 | A | * | 8/1913 | Browning | 42/7 |
| 1,376,165 | A | * | 4/1921 | Rosebush | 42/7 |
| 2,324,125 | A | * | 7/1943 | Van Horn et al. | 42/69.03 |
| 3,492,748 | A | * | 2/1970 | Swenson | 42/70.01 |
| 3,722,358 | A | * | 3/1973 | Seecamp | 89/147 |
| 3,964,368 | A | * | 6/1976 | Zimeri Safie | 89/14.1 |
| 4,742,634 | A | * | 5/1988 | Swenson | 42/70.01 |
| 4,800,665 | A | * | 1/1989 | Schumaker | 42/70.01 |
| 4,862,618 | A | | 9/1989 | Szabo | |
| 5,036,612 | A | * | 8/1991 | Jennings | 42/70.08 |
| 5,086,579 | A | * | 2/1992 | Flatley et al. | 42/69.03 |
| 6,256,918 | B1 | | 7/2001 | Szabo | |
| 6,283,006 | B1 | | 9/2001 | Szabo et al. | |
| 6,341,442 | B1 | | 1/2002 | Szabo et al. | |

* cited by examiner

*Primary Examiner*—Charles T. Jordan
*Assistant Examiner*—John W. Zerr
(74) *Attorney, Agent, or Firm*—Finnegan, Henderson, Farabow, Garrett & Dunner, L.L.P.

(57) ABSTRACT

A government model semi-automatic handgun is disclosed. The handgun includes a frame having a rear end, a barrel having a tip, and a slide having a front side and a back side, and a grip safety having an outer surface. An outer surface of the hammer substantially aligns with the back side of the slide when the slide is in a forward position and the hammer is in a rest position. In addition, the length of the handgun as defined by between the barrel tip and the rear end of the frame may be greater than the length of the handgun as defined by the barrel tip and the outer surface of the grip safety.

44 Claims, 17 Drawing Sheets

COMPACT GOVERNMENT MODEL HANDGUN

RELATED APPLICATIONS

This application claims the benefit of U.S. provisional application No. 60/250,463, filed on Dec. 4, 2000, which is expressly incorporated herein by reference.

BACKGROUND OF THE INVENTION

The present invention relates to a government model semi-automatic handgun. More particularly the invention relates to a compact government model semi-automatic handgun.

There are a large variety of handguns available on the market. Each type of handgun has different design features, which may make a particular handgun more suitable for a particular user or purpose. The government model handgun, for example has certain characteristics that make it the preferred sidearm for many law enforcement and military personnel. In particular, the safety features, reliable operation, and ammunition-carrying characteristics inherent in the design of the government model make the weapon well suited for the needs of law enforcement and military users.

Conventional government model handguns (also referred to as 1911A1 model handguns) have typically been single action handguns. In a single action handgun, the hammer of the handgun must be cocked prior to pulling the trigger to fire a round. The hammer may be cocked manually, by retracting the hammer or by "racking" the slide, or automatically, by the recoil action of the slide acting on the hammer.

One of the noted safety features of a government model handgun is a grip safety. The grip safety is operatively engaged with the hammer of the handgun to prevent the hammer from moving until the grip safety is released. As its name implies, the grip safety is located in the grip of the handgun and is disengaged when a user picks up the gun and holds it in a firing position. This helps prevent the weapon from discharging when the handgun is not held in a firing position.

However, the design of the government model does have certain drawbacks. For example, to facilitate manual retraction of the hammer, the hammer includes a spur that projects from the rear of the slide. The spur includes a series of ridges to allow the user to retract the hammer with his thumb. After a fired shot, however, the recoil action of the slide moves the spur of the hammer into close proximity to the top of the grip safety. For certain users, who have large hands, a potential exists for the web of skin between the thumb and forefinger to be pinched between the hammer spur and the grip safety.

To prevent this painful occurrence, the grip safety of the government model has been made with a safety ridge to prevent the user's hand from entering the gap between the hammer and grip to thereby prevent the possibility of pinching the web. In some models equipped with a "beaver tail," the safety ridge extends a greater distance from the frame of the handgun. However, the extended safety ridge also increases the overall profile of the weapon, which makes it difficult to remove the gun quickly and smoothly from a holster.

In light of the foregoing there is a need for a compact version of a government model semi-automatic handgun.

SUMMARY OF THE INVENTION

Accordingly, the present invention is directed to a government model handgun that obviates one or more of the limitations and disadvantages of the prior art government model handguns. The advantages and purposes of the invention will be set forth in part in the description which follows, and in part will be obvious from the description, or may be learned by practice of the invention.

One aspect of the invention is directed to a semi-automatic handgun that includes a frame and a slide having a front side and a back side. The slide is mounted on the frame for sliding movement between a forward position and a backward position. A hammer is mounted on the frame for pivoting movement between a rest position and a rearward position. The hammer has an outer surface that is configured to substantially align with the back side of the slide when the slide is in the forward position and the hammer is in the rest position. A grip safety is disposed in the frame and has a safe position where the grip safety prevents the hammer from moving.

Another aspect of the invention is directed to a semi-automatic handgun that has a frame having a rear end, a barrel having a tip, and a slide having a front side and a back side. The slide is mounted on the frame for sliding movement between a forward position and a backward position. A hammer is mounted on the frame for pivoting movement between a rest position and a rearward position. The hammer has an outer surface that is configured to substantially align with the back side of the slide when the slide is in the forward position and the hammer is in the rest position. A grip safety having an outer surface is disposed in the frame. The grip safety has a safe position where the grip safety prevents the hammer from moving. The length of the handgun as defined by the barrel tip and the rear end of the frame is greater than the length of the handgun as defined by the barrel tip and the outer surface of the grip safety.

Yet another aspect of the invention is directed to a semi-automatic handgun that includes a frame having a rear end, a barrel having a tip, and a slide having a front side and a back side. The slide is mounted on the frame for sliding movement between a forward position and a backward position. A hammer is mounted on the frame for pivoting movement between a rest position and a rearward position. A grip safety is disposed in the frame and has an outer surface. The grip safety has a safe position where the grip safety prevents the hammer from moving. The length of the handgun as defined by the barrel tip and the rear end of the frame is greater than the length of the handgun as defined by the barrel tip and the outer surface of the grip safety.

Still another aspect of the invention is directed to a method of manufacturing a semi-automatic handgun. A frame having a rear end is provided. A slide having a front side and a back side is mounted on the frame for sliding movement between a forward position and a backward position. A hammer is mounted on the frame for pivoting movement between a rest position and a rearward position. The hammer has an outer surface configured to substantially align with the back side of the slide when the slide is in the forward position and the hammer is in the rest position. A grip safety having an outer surface is disposed in the frame. The grip safety is operatively connected to the hammer to prevent the hammer from moving.

A further aspect of the invention is directed to a method of manufacturing a semi-automatic handgun. A frame having a rear end is provided. A barrel having a tip is disposed on the frame. A slide having a front side and a back side is mounted on the frame for sliding movement between a forward position and a backward position. A grip safety having an outer surface is disposed in the frame. The grip safety is operable to selectively prevent the semi-automatic handgun from firing. The length of the handgun as defined by the barrel tip and the rear end of the frame is greater than the length of the handgun as defined by the barrel tip and the outer surface of the grip safety.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Figure 1A:
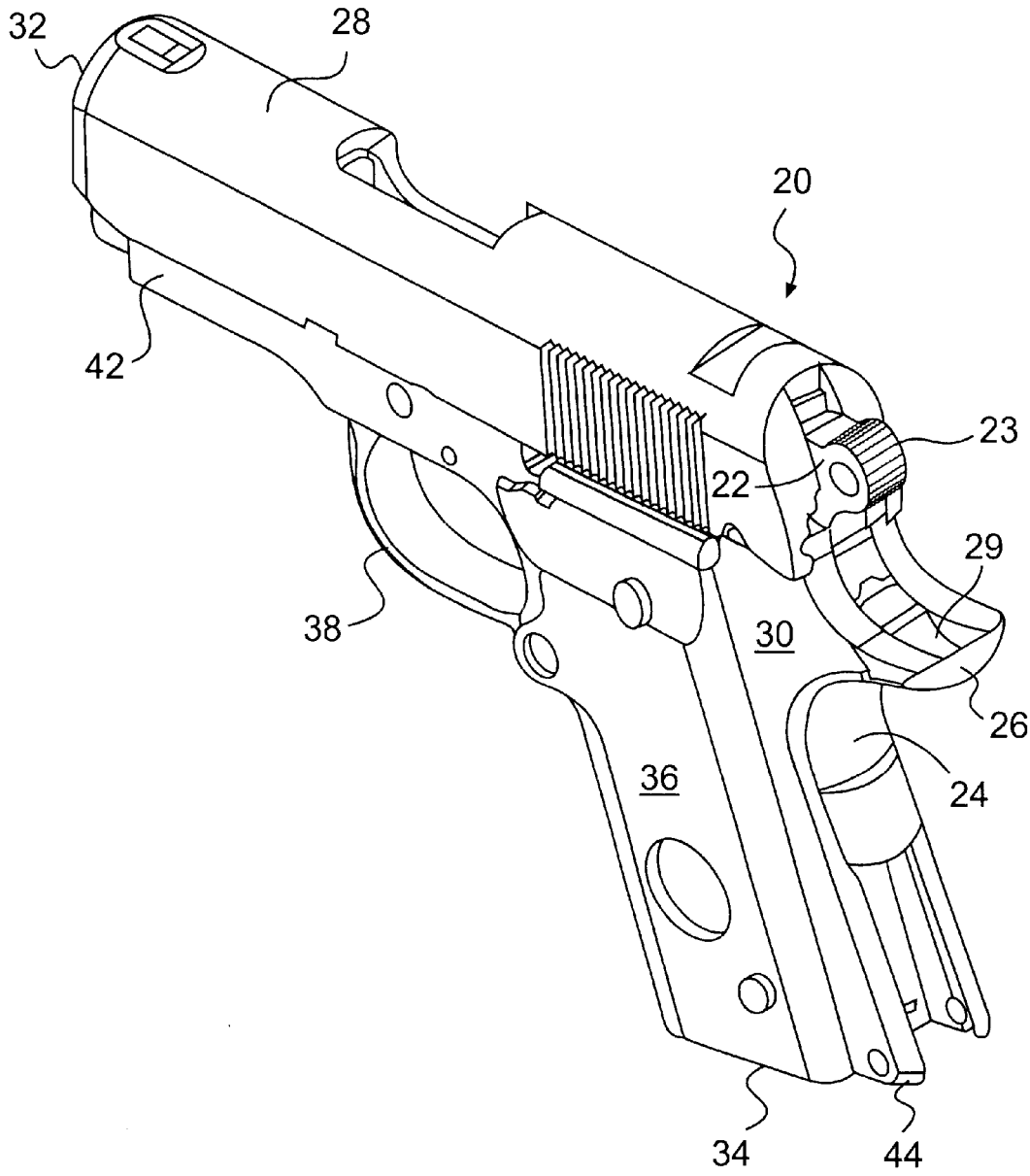
FIG. 1a PRIOR ART
FIG. 1*a* is a perspective view of a conventional government model semiautomatic handgun.

Reference will now be made in detail to the presently preferred embodiments of the invention, examples of which are illustrated in the accompanying drawings. Wherever possible, the same reference numbers will be used throughout the drawings to refer to the same or like parts.

As illustrated in the accompanying Figures, a compact government model semi-automatic handgun is provided. For the purposes of this disclosure, the term "government model" refers to the 1911A1 semi-automatic handgun. The 1911A1 model handgun is disclosed in U.S. Pat. No. 984,519, which is hereby incorporated by reference. U.S. Pat. No. 984,519 discloses the overall structure and operation of the 1911A1 model handgun and its disclosure of the basic structural components and operation will not be repeated. A 1911A1 model handgun is shown in FIGS. 1*a*–1*b* and is designated generally by reference number 20.

For the purposes of this disclosure, the "front" of the handgun refers to the barrel exit side (reference number 32), the "top" of the handgun refers to the slide side (reference number 28), the "rear" of the handgun refers to the grip safety side (reference number 24), and the "bottom" of the handgun refers to the magazine entrance side (reference number 34).

As illustrated in FIG. 1*a,* a conventional government model handgun includes a frame 30. Frame 30 includes a slide support 42, a magazine entrance 34 disposed at the lower end of a grip 36, and a trigger guard 38. Frame 30 mounts a hammer 22 that is disposed at the rear of the handgun, a slide 28 that is disposed on frame support 42 at the top of the handgun, and a grip safety 26 that is disposed at the rear of the handgun.

Figure 1B:
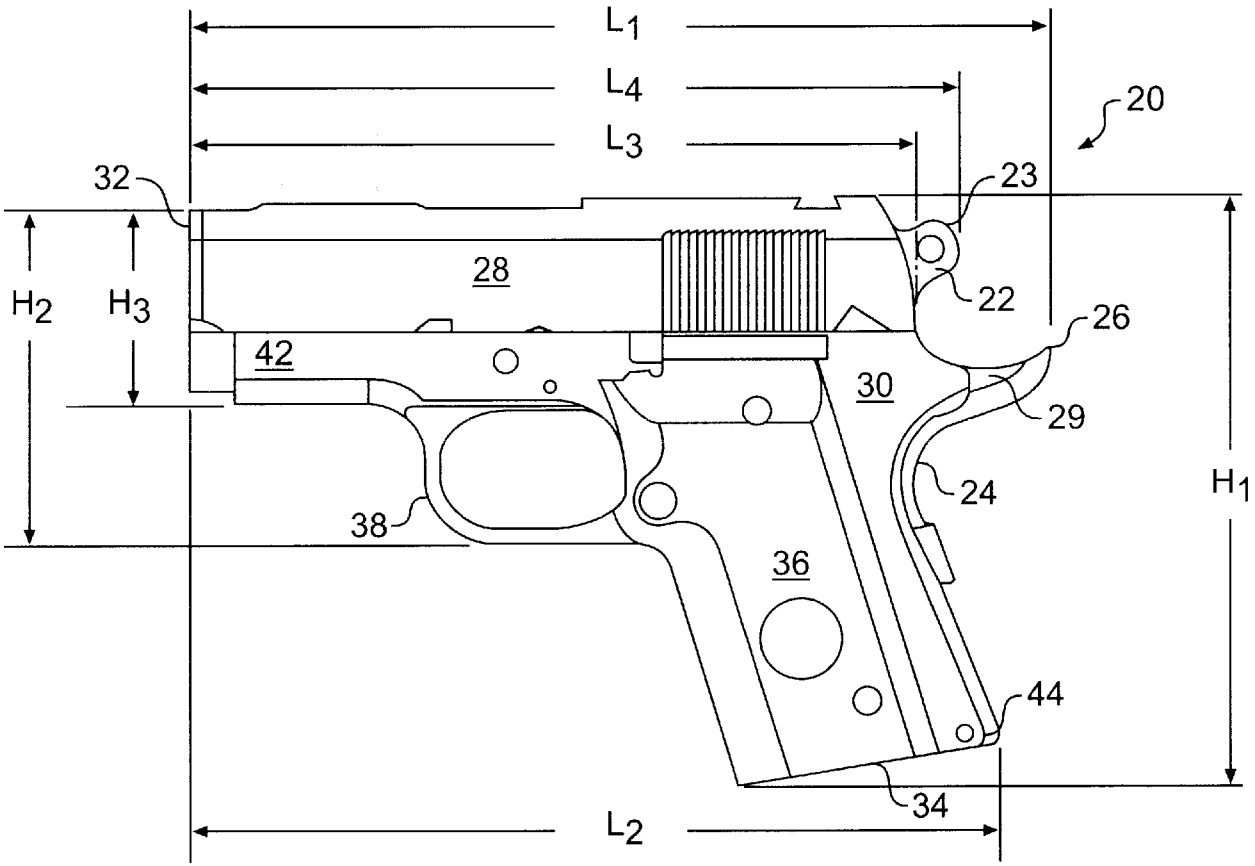
FIG. 1b PRIOR ART
FIG. 1*b* is a side view of the handgun of FIG. 1*a;*

FIG. 1*b* illustrates the typical dimensions used to represent the size of a handgun. The height of the handgun can be measured in three distances: (1) the distance between the top of slide 28 and the bottom of grip 36 (as indicated by $H_1$); (2) the distance between the top of slide 28 and the lower portion of trigger guard 38 (as indicated by $H_2$); and (3) the distance between the top of slide 28 and the lower portion of slide support 42 (as indicated by $H_3$).

In a conventional government model handgun, $H_1$ is approximately 4.65 inches, $H_2$ is approximately 2.65 inches, and $H_3$ is approximately 1.53 inches.

The length of the handgun can be measured in four distances: (1) the distance between barrel tip 32 and the rear of grip safety 26 (as indicated by $L_1$); (2) the distance between barrel tip 32 and the rear of frame 44 (as indicated by $L_2$); (3) the distance between barrel tip 32 and the rear end of slide 28 (as indicated by $L_3$); and (4) the distance between barrel tip 32 and the rear of hammer 22 (as indicated by $L_4$).

In a conventional government model handgun, with a "beaver tail" type grip safety (as illustrated in FIGS. 1*a* and 1*b*), $L_1$ is approximately 6.72 inches, $L_2$ is approximately 6.36 inches, $L_3$ is approximately 5.67 inches, and $L_4$ is approximately 6.02 inches.

Figure 2A:
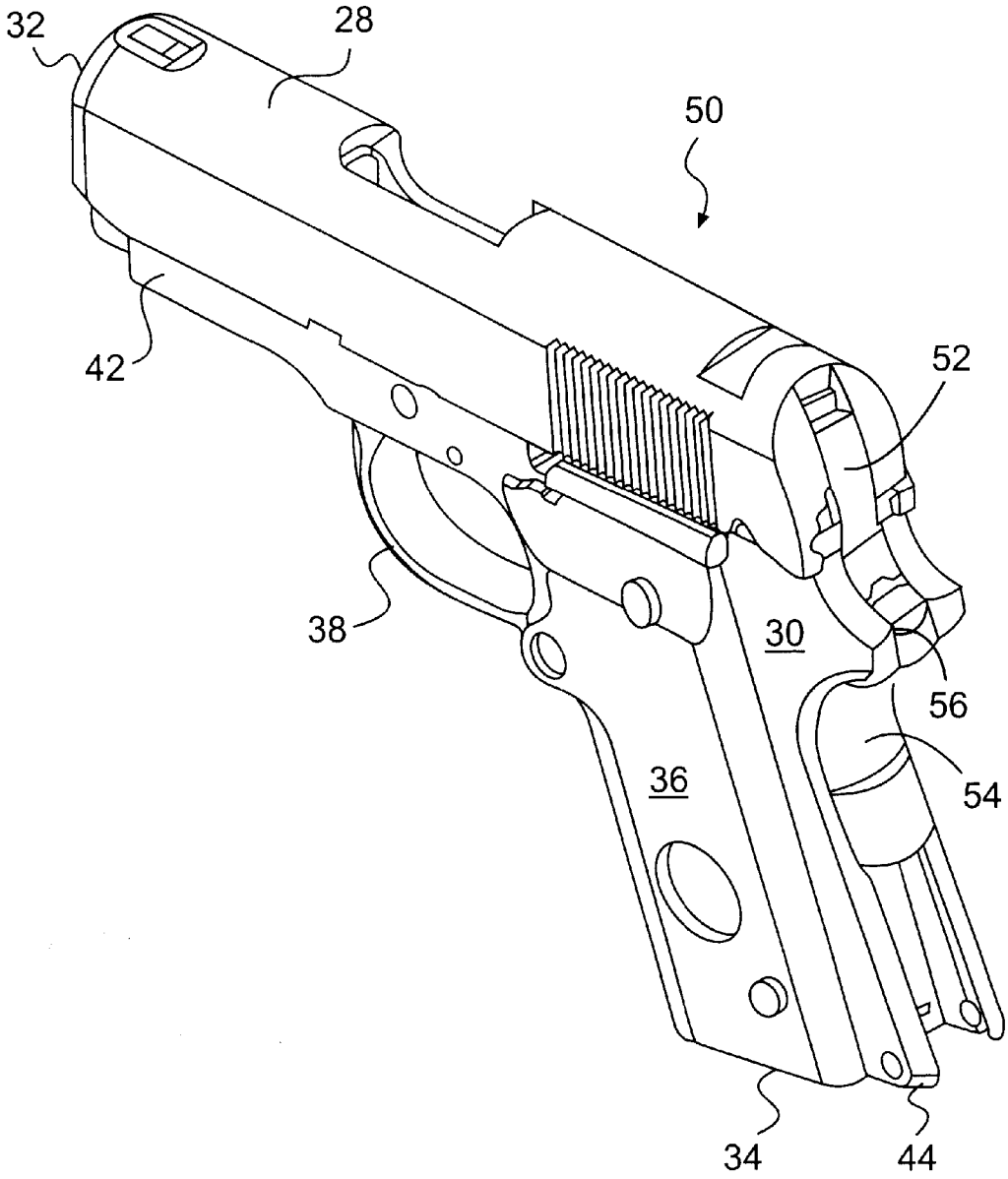
FIG. 2*a* is a perspective view of a government model semi-automatic handgun according to an embodiment of the present invention.
Figure 2B:
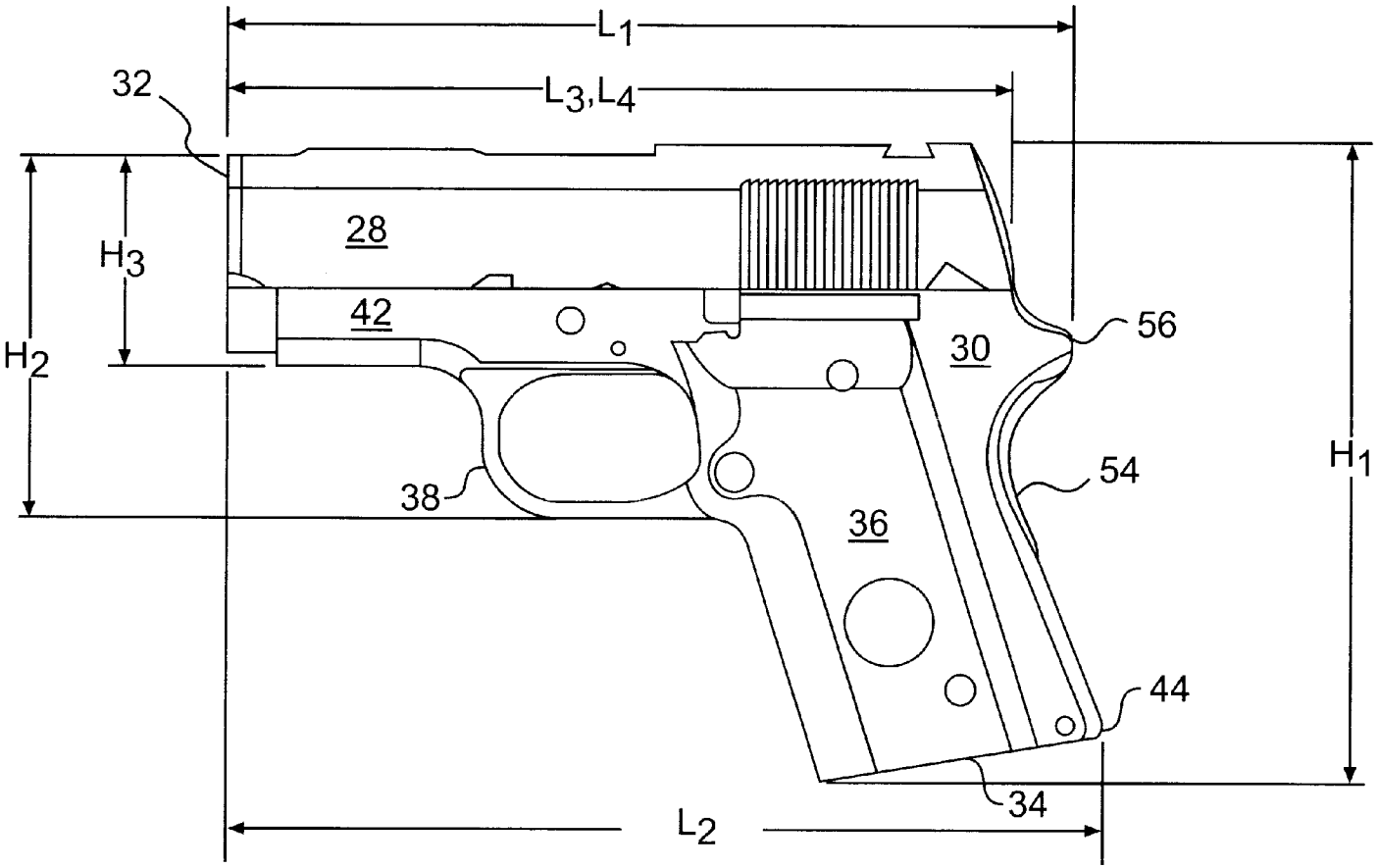
FIG. 2*b* is a side view of the handgun of FIG. 2*a;*

An embodiment of a government model handgun according to the present invention is illustrated in FIGS. 2*a* and 2*b* and is generally designated by the reference number 50. It is contemplated that the handgun may operate as either a single action or a double action. As is known in the art, the conventional government model handgun is a singe action, meaning that the hammer must be cocked prior to pulling the trigger. The hammer may be cocked manually, by retracting the hammer to engage it with the sear or by manually retracting, or "racking," the slide. The recoil action of the slide may also cock the hammer.

As described in co-pending U.S. patent application Ser. No. 09/139,027, the disclosure of which is hereby incorporated by reference in its entirety, a government model handgun may also operate in a double action mode. U.S. patent application Ser. No. 09/139,027 discloses the structure an action government model handgun in detail and its disclosure of the structural components and operation will not be repeated.

Figure 3:
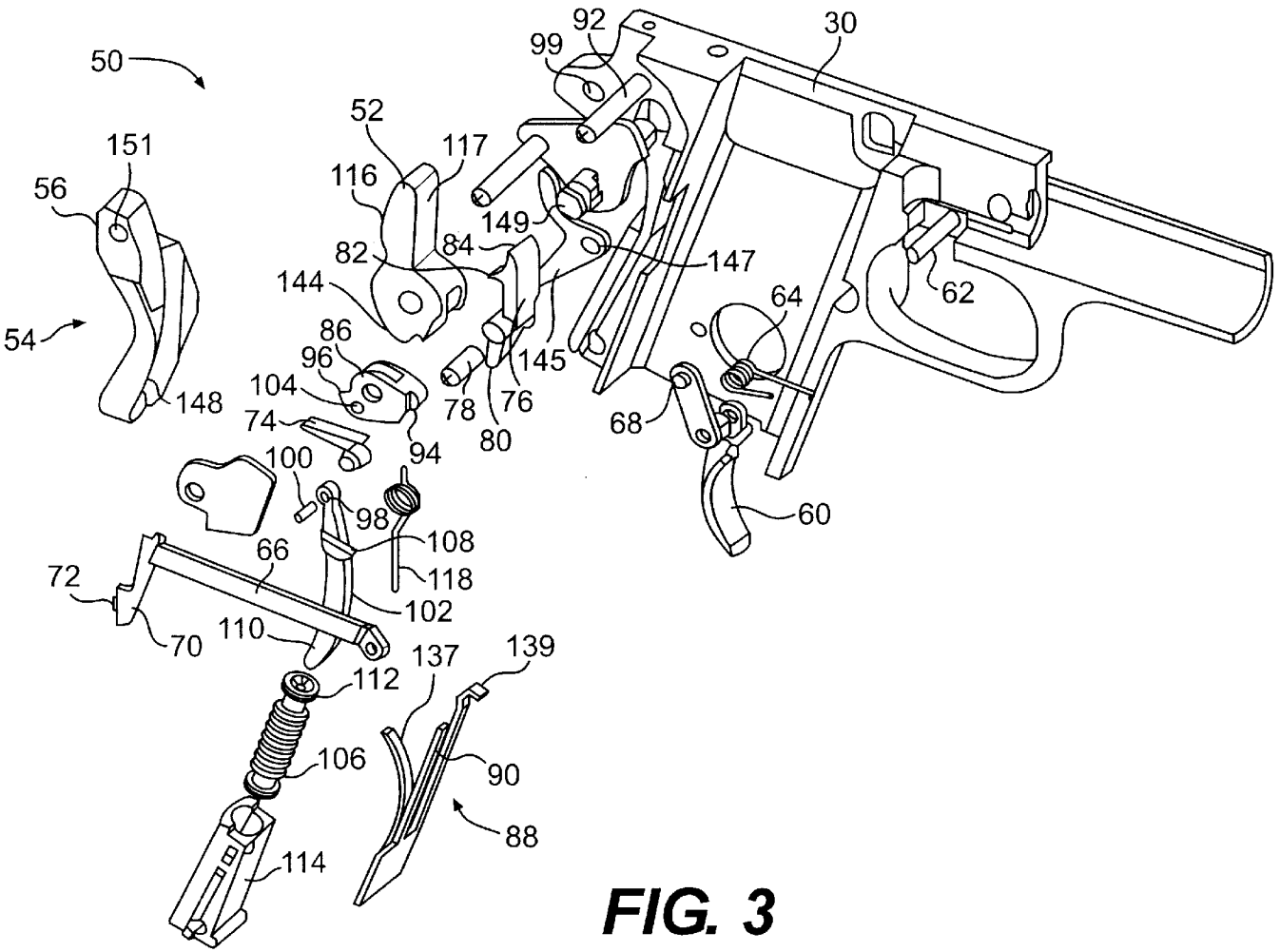
FIG. 3 is an exploded view of a government model handgun according to an embodiment of the present invention.

Handgun 20, may include a double action trigger mechanism, which may be, for example, similar to that described in U.S. patent application Ser. No. 09/139,027. As illustrated in FIG. 3, a trigger 60 is pivotally disposed on frame 30 with a trigger pin 62. A trigger spring 64 is positioned adjacent trigger 60 and biases trigger 60 to a forward position. Trigger 60 is connected to a drawbar 66 with a pin 68.

Drawbar 66 is slidably disposed in frame 30 and has a rear leg 70. A tab 72 extends from rear leg 70. A drawbar spring 74 acts on rear leg 70 to bias drawbar 66 upwardly.

The handgun also includes a sear 76 that is preferably rotatably mounted on a sear pin 78. Sear 76 has a lower tab 80, a drawbar contact 82, and a main contact 84. Sear 76 is positioned adjacent a hammer cam 86 and proximate a leaf spring 88. Leaf spring 88 has a sear prong 90 that contacts lower tab 80 of sear 76 to bias main contact 84 of sear 76 towards hammer cam 86.

The hammer cam 86 is rotatably mounted on a hammer pin 92. Hammer cam 86 has a first engagement step 94 and a second engagement step 96. Hammer cam 86 is connected to a strut 102 by a pin 100 that engages an opening 104 in the hammer cam 86 and an opening 98 in strut 102. Strut 102 connects hammer cam 86 to a hammer spring 106. Preferably, strut 102 has a boss 108 and a lower end 110. Lower end 110 of strut 102 engages a plug 112 that fits within hammer spring 106. Hammer spring 106 is supported within main spring housing 114.

The pin 100 and opening 104 in hammer cam 86 are positioned such that the rotation of the hammer cam results in a generally downward motion of strut 102. The generally downward motion of strut 102 compresses hammer spring 106. The compressed hammer spring 106 acts on hammer cam 86 through strut 102 to bias hammer cam 86 to rotate about hammer pin 92.

Hammer cam 86 is rotatable into a cocked position, where sear 76 engages first engagement step 94 of hammer cam 86. The rotation of hammer cam 86 to reach this position moves strut 102 generally downward, which compresses hammer spring 106. Thus, the engagement of sear 76 with hammer cam 86 holds hammer spring 106 in a compressed position, thereby storing the energy of the compressed hammer spring 106.

When sear 76 is disengaged from hammer cam 86, hammer spring 106 acts on hammer cam 86 to rotate hammer cam 86. The released hammer spring 106 acts on hammer cam 86 through strut 102. The force of hammer spring 106 rotates hammer cam 86 back to the uncocked position.

As also shown in the Figures, handgun 20 includes a hammer. The hammer has a cocked and an uncocked position and includes an outer surface and a contact surface. The outer surface of the hammer substantially aligns with a rear surface of the slide when the hammer is in the uncocked position.

As illustrated in FIG. 3, handgun 50 includes hammer 52, hammer pin 92, and a hammer return spring 118. Hammer 52 includes an outer surface 116 and a contact surface 117 and is rotatably mounted on hammer pin 92. Hammer return spring 118 acts on the hammer 52 to rotate it about the hammer pin 92 from the cocked position to the uncocked position.

Figure 4B:
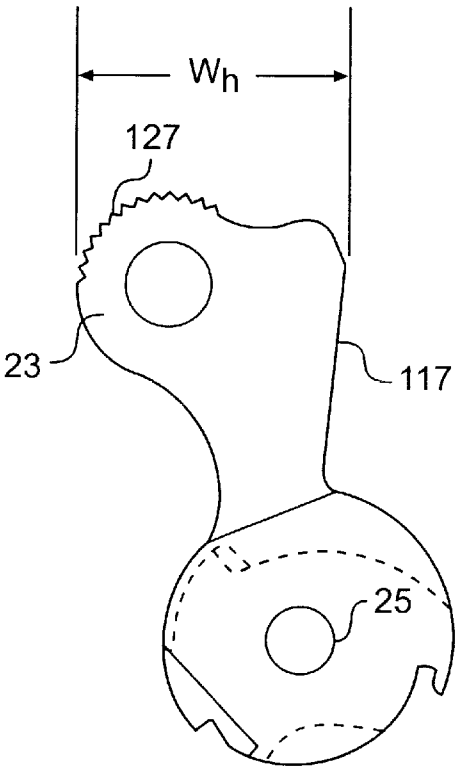
FIG. 4b PRIOR ART
FIG. 4*b* is a side view of the hammer of FIG. 4*a;*
Figure 4A:
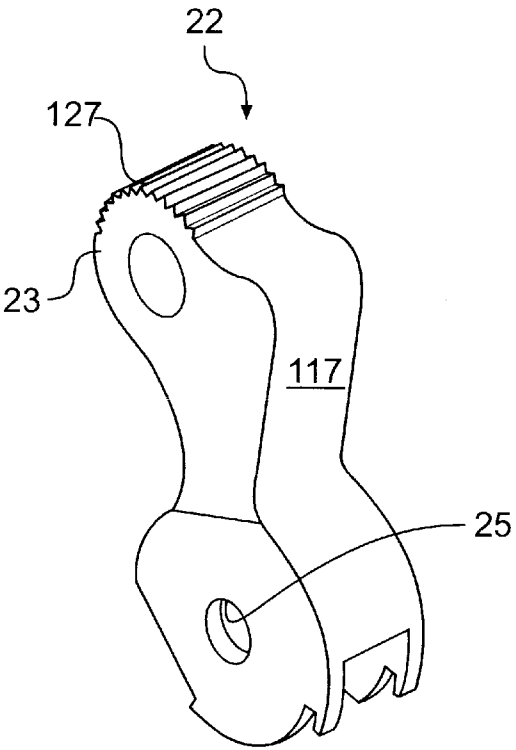
FIG. 4a PRIOR ART
FIG. 4*a* is a perspective view of a hammer for a government model handgun having a conventional spur.

FIGS. 4*a* and 4*b* illustrate a hammer 22 for a conventional government model handgun. Hammer 22 includes a spur 23 and an opening 25. Opening 25 is configured to receive hammer pin 92. Spur 23 extends from the rear of the handgun (as illustrated in FIGS. 1*a* and 1*b*) and includes a series of ridges 127. Spur 23 of hammer 22 has a width $W_h$. In a conventional hammer, $W_h$ is approximately 0.62 inches.

When operating the conventional handgun, a user may manually retract hammer 22 by gripping ridges 127 of hammer 22 with a thumb and pivoting hammer 22 about the hammer pin 92. In this manner, the conventional handgun may be manually cocked. In addition, the recoil action of slide may pivot hammer 22 about hammer pin 92 to automatically cock the conventional handgun after each round is fired.

Figure 5C:
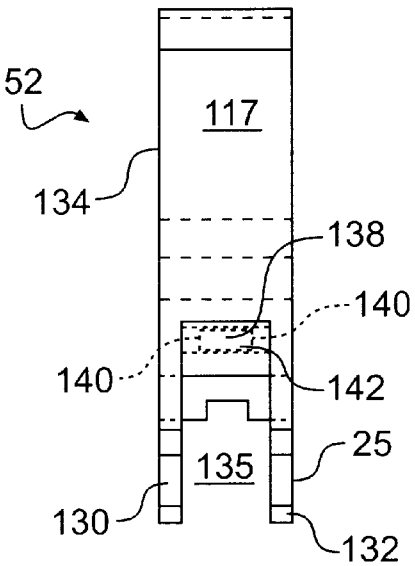
FIG. 5*c* is a front view of the hammer of FIG. 5*a;*
Figure 5B:
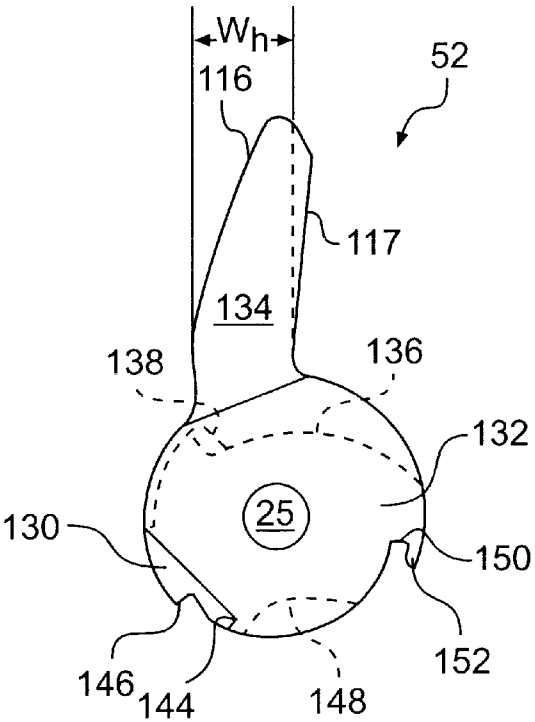
FIG. 5*b* is a side view of the hammer of FIG. 5*a;*
Figure 5A:
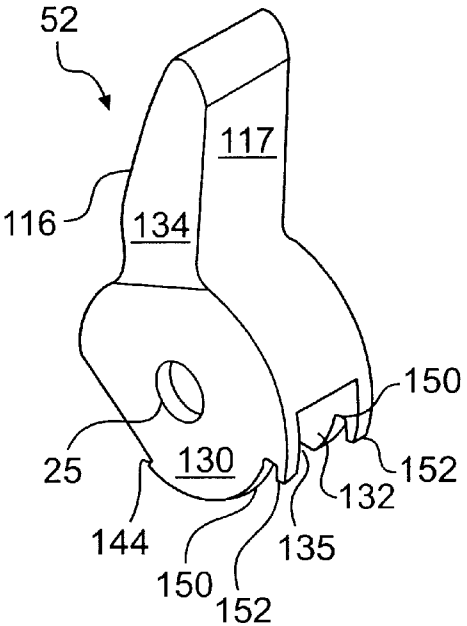
FIG. 5*a* is a perspective view of a hammer for a government model handgun according to an embodiment of the present invention.

FIGS. 5*a*–5*c* illustrate a hammer 52 according to the present invention. Hammer 52 includes a firing section 134 that is joined to a first side support 130 and a second side support 132. Firing section 134 includes a contact surface 117 and an outer surface 116. Outer surface extends in a substantially direct line from side supports 130 and 132 to the top of hammer 52. Notably, the hammer spur present in the conventional government model handgun hammer is excluded from the hammer of the present invention. The greatest width of firing section 134 is indicated as $W_h$ in FIG. 5*b*. Preferably, $W_h$ is approximately 0.30 inches, which is less than half of the greatest width of the conventional hammer. More preferably, $W_h$ is approximately 0.295 inches.

First and second side supports 130 and 132 define a slot 135 having an interior surface 136. As illustrated in FIG. 5*c*, a groove 138 is positioned at the rear of interior surface 136 to form a cam contact 140 and a return spring contact 142.

As shown in FIG. 5*a*, the outer edge of first side support 130 defines a drawbar notch 144. As shown in FIG. 5*b*, the outer edge of second side support 132 defines a grip safety notch 146 and a manual safety groove 148. The outer edges of each of the first and second side supports 130 and 132 also include a half-cock notch 150. Each half-cock notch 150 has an outer tab 152.

Hammer cam 86 is detachably coupled with hammer 52. Hammer cam 86 is preferably positioned between the side supports 130 and 132 of hammer 52. Both hammer 52 and hammer cam 86 are rotatably disposed on hammer pin 92. When hammer cam 86 is in the uncocked position (as described previously), second engagement step 96 of hammer cam 86 engages cam contact 140 of hammer 52. Because of this engagement, a rearward rotation of hammer 52 from the uncocked position will translate to a corresponding rearward rotation of hammer cam 86.

After hammer 52 and hammer cam 86 have been rotated through a certain angle, main contact 84 of sear 76 engages first engagement step 94 of hammer cam 86. Preferably, sear 76 will engage first engagement step 94 of hammer cam 86 after the hammer and hammer cam have been rotated about 60° from the fully uncocked position (or approximately 55° past vertical).

As discussed previously, hammer 52 of the present invention does not include a spur. Accordingly, the retraction of hammer 52 to cock hammer cam 86 may be accomplished by a rearward motion of slide 28. Slide 28 may be moved manually or automatically in response to a fired round. In either case, slide 28 will retract hammer 52 sufficiently to allow sear 76 to engage and hold hammer cam 86 in the cocked position.

After sear 76 engages hammer cam 86, hammer return spring 118 biases hammer 52 away from hammer cam 86.

Hammer 52 rotates forwardly until half-cock notches 150 engage main contact 84 of sear 76. Thus, the hammer cam remains engaged with sear 76 in the cocked position to hold hammer spring 106 compressed while hammer 52 is biased out of engagement with hammer cam 86 and into the half-cocked position.

Drawbar 66 is positioned such that rear tab 72 is adjacent hammer 52. Trigger spring 64 acts indirectly through the trigger on drawbar 66 to bias it into a rearward position and drawbar spring 74 acts on rear leg 70 to bias drawbar upwardly. The upward bias of drawbar spring 74 ensures that rear tab 72 will engage drawbar notch 144 of hammer 52. Rear tab 72 is also aligned with drawbar contact 82 of sear 76.

Preferably, strut 102 includes a boss 108. Boss 108 is positioned on strut 102 such that when hammer cam 86 is in the uncocked position, boss 108 aligns with rear tab 72 of drawbar 66 and prevents drawbar 66 from moving. Thus, when hammer cam 86 is in the uncocked position boss 108 may prevent drawbar 66 from moving into engagement with drawbar notch 144 on hammer 52.

Movement of hammer cam 86 to the cocked position similarly moves strut 102 downwardly so that boss 108 moves out of alignment with rear tab 72 of drawbar 66. Thus, when hammer cam 86 is in the cocked position, boss 108 does not prevent trigger 60 from being pulled.

When hammer cam 86 is cocked and drawbar 66 moves forward in response to a trigger pull, rear tab 72 engages drawbar notch 144 on hammer 52 and causes hammer 52 to rotate rearwardly. As the trigger pull continues, rear tab 72 of drawbar will eventually make contact with drawbar engagement 82 of sear 76. Rear tab 72 disengages sear 76 from hammer cam 86 thereby releasing the compressed hammer spring 106.

When hammer spring 106 is released, it acts through strut 102 to cause hammer cam 86 to rotate. As hammer cam 86 rotates, second engagement step 96 of hammer cam 86 approaches cam contact 140 of hammer 52. Just prior to second engagement step 96 engaging cam contact 140, hammer cam 86 rotates into engagement with rear tab 72 of the drawbar. The contact moves rear tab 72 away from drawbar notch 144 to release hammer 52. The second engagement step 96 then contacts cam contact 140 of hammer 52 to rotate it forwardly to fire the handgun.

As further shown in the Figures, handgun 20 includes a grip safety. As illustrated in FIG. 3, the grip safety includes a grip portion 54 and a lever 145. Grip portion 54 includes an opening 151 that aligns with an opening 99 in frame 30. A pin (not shown) connects grip portion 54 to the frame 30 to allow grip portion 54 to rotate relative to frame 30. Grip portion 54 also includes a groove having an inner surface 148.

Lever 145 has an opening 147 and a hammer engagement 149. Opening 147 engages sear pin 78 upon which lever 145 rotates. Hammer engagement 149 is positioned to engage grip safety notch 146 in hammer 52. The lower end of lever 145 and lower end 144 slides along surface 148 of grip portion 54.

Leaf spring 88 has a grip prong 137 and a lever prong 139. Grip prong 137 acts on grip portion 54 to rotate the grip portion 54 to a rearward position. Lever prong 139 acts on the upper end of lever 149 to rotate hammer engagement 149 into engagement with grip safety notch 146 of hammer 52.

When the handgun is not held in a typical firing position, i.e. the grip portion 54 of grip safety is not held by a user's hand, leaf spring 88 biases the grip safety into a safe position, where the hammer engagement 149 of lever 145 engages grip safety notch 146 of hammer 52. This engagement prevents the hammer from rotating when the grip is not being held and will prevent the handgun from firing unless the handgun is properly held. Alternatively, the grip safety may be designed to block another component of the handgun, such as the sear or drawbar, to prevent accidental discharges of the weapon.

When a user grips the handgun 50 in a typical firing position, the user moves the grip portion 54 relative to the frame 30. The force exerted on grip portion 54 overcomes the bias of leaf spring 88 and moves the grip portion 54 moves to a forward, firing position. As grip portion 54 moves relative to frame 30, the lower end of lever 145 slides along inner surface 148 of grip portion 54, thereby causing lever 145 to rotate about sear pin 78. This rotation causes hammer engagement 149 to rotate out of engagement with grip safety notch 146 of hammer 52. In this firing position, hammer 52 may freely rotate with respect to frame 30 so that the handgun may be fired.

Figure 6B:
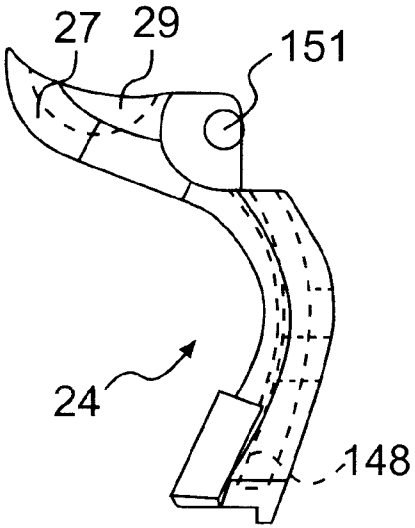
FIG. 6b PRIOR ART
FIG. 6*b* is a side view of a second conventional grip portion of a grip safety for a government model handgun.
Figure 6A:
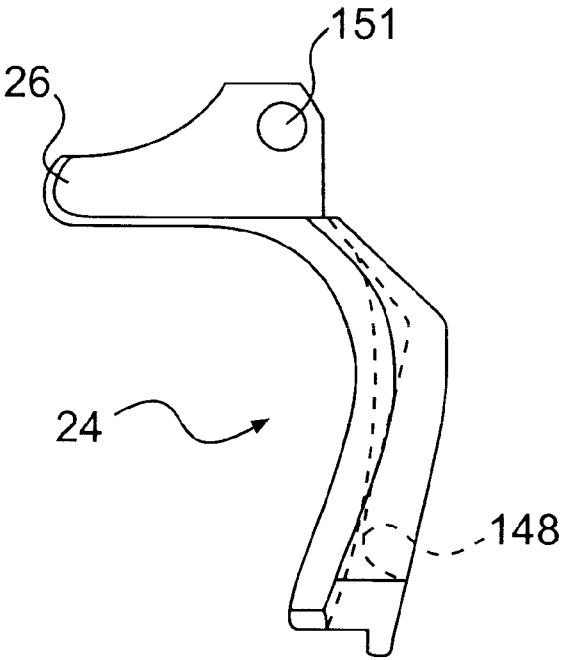
FIG. 6a PRIOR ART
FIG. 6*a* is a side view of a conventional grip portion of a grip safety for a government model handgun.

FIGS. 6*a* and 6*b* illustrate two conventional grip portions of a grip safety for a government model handgun. As shown in FIG. 6*a,* grip portion 24 includes a safety ridge 26 that extends away from opening 151. In the grip portion 24 illustrated in FIG. 6*b*, grip portion 24 includes a larger safety ridge 27 known as a beaver tail. The beaver tail safety ridge 27 also includes an opening 29 configured to receive spur 23 of hammer 22 when the hammer is retracted by the recoil action of the slide. Thus, the safety ridges 26 and 27 protect a user's hand from being pinched between spur 23 of hammer 22 (referring to FIGS. 4*a* and 4*b*) and grip portion 24 of the grip safety.

Figure 7C:
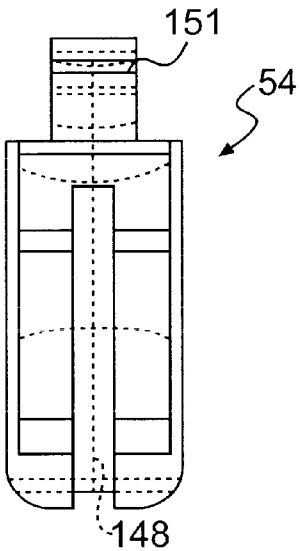
FIG. 7*c* is a front view of the grip portion of FIG. 7*a;*
Figure 7B:
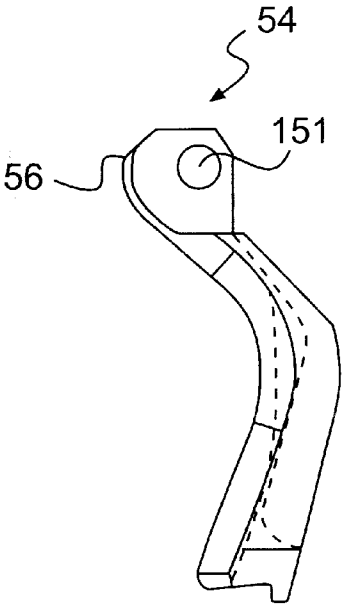
FIG. 7*b* is a side view of the grip portion of FIG. 7*a;*
Figure 7A:
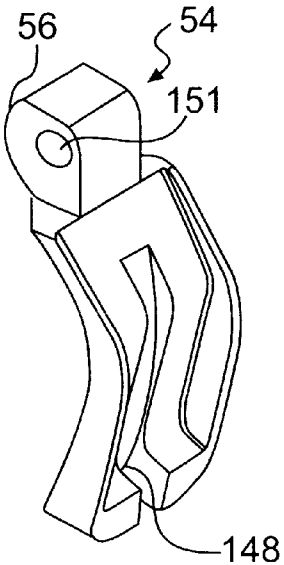
FIG. 7*a* is a perspective view of a grip portion of a grip safety for a government model handgun in accordance with an embodiment of the present invention.

FIGS. 7*a*–7*c* illustrate a grip portion 54 of a grip safety according to exemplary embodiments of the present invention. Grip portion 54 includes an outer surface 56. Outer surface 56 generally follows the contours of opening 151. Notably absent is a safety ridge extending away from opening 151.

Figure 9A:
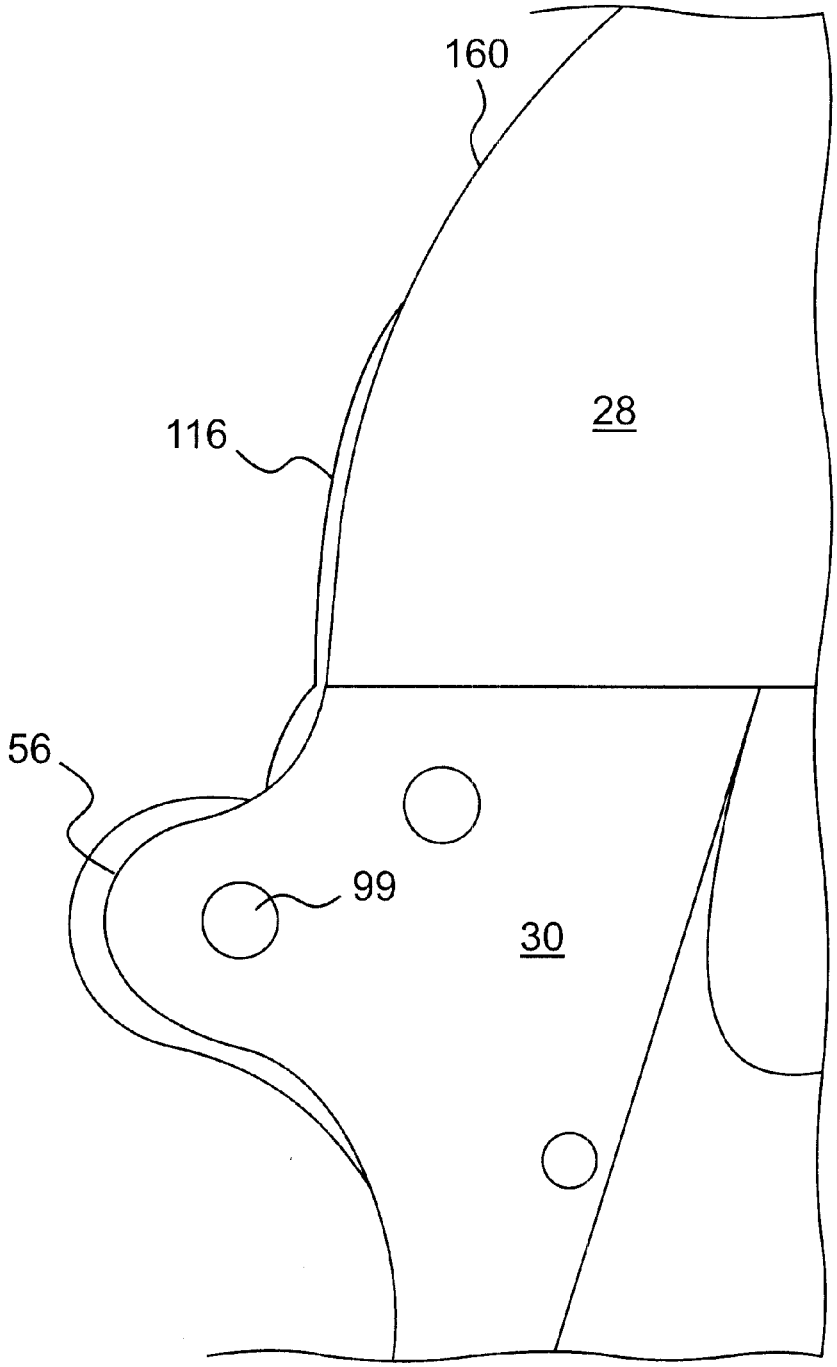
FIG. 9*a* is a side view of a government model handgun according to an embodiment of the present invention, illustrating the hammer in a rest position.
Figure 9B:
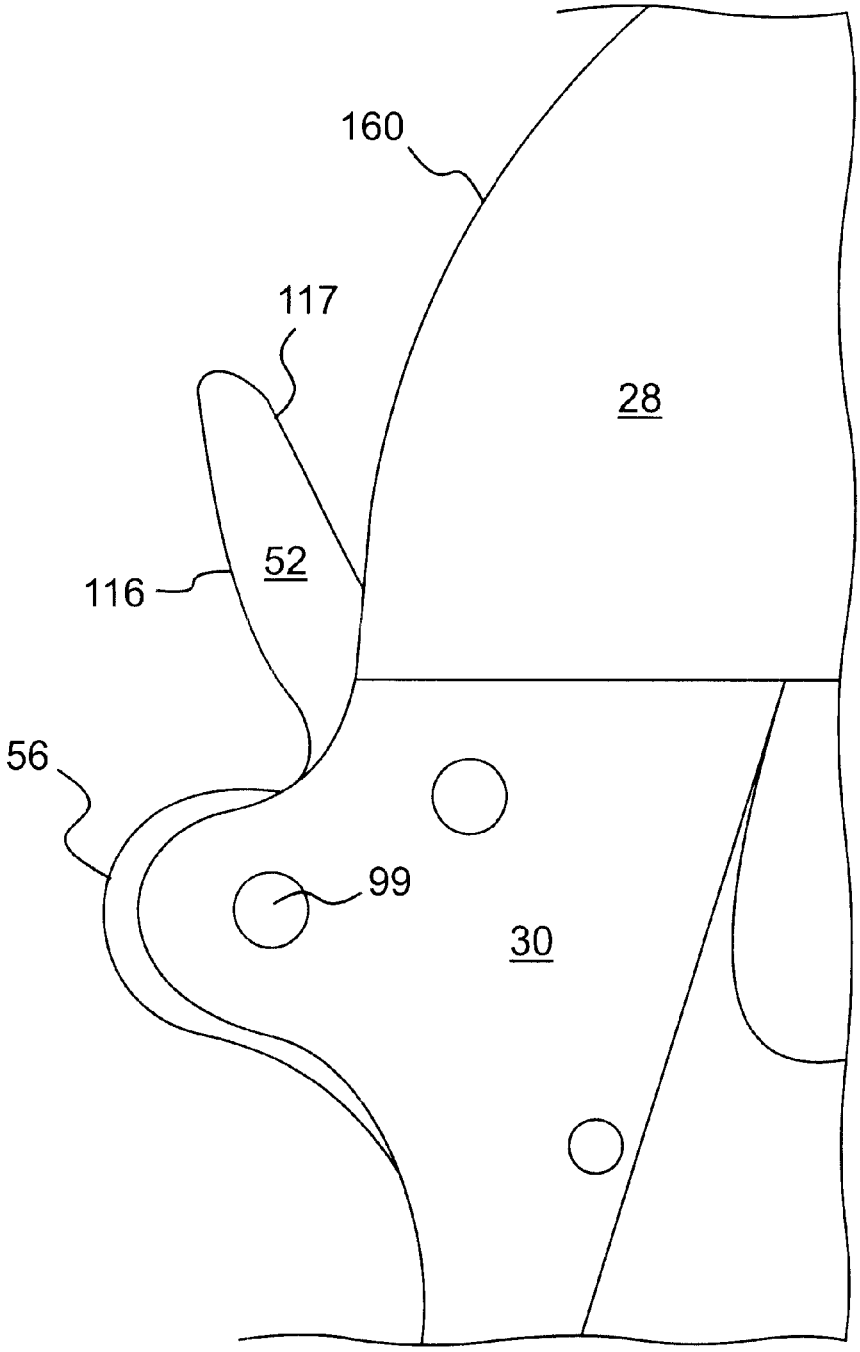
FIG. 9*b* is a side view of the handgun of FIG. 9*a,* illustrating the hammer in a half-cocked position.
Figure 9C:
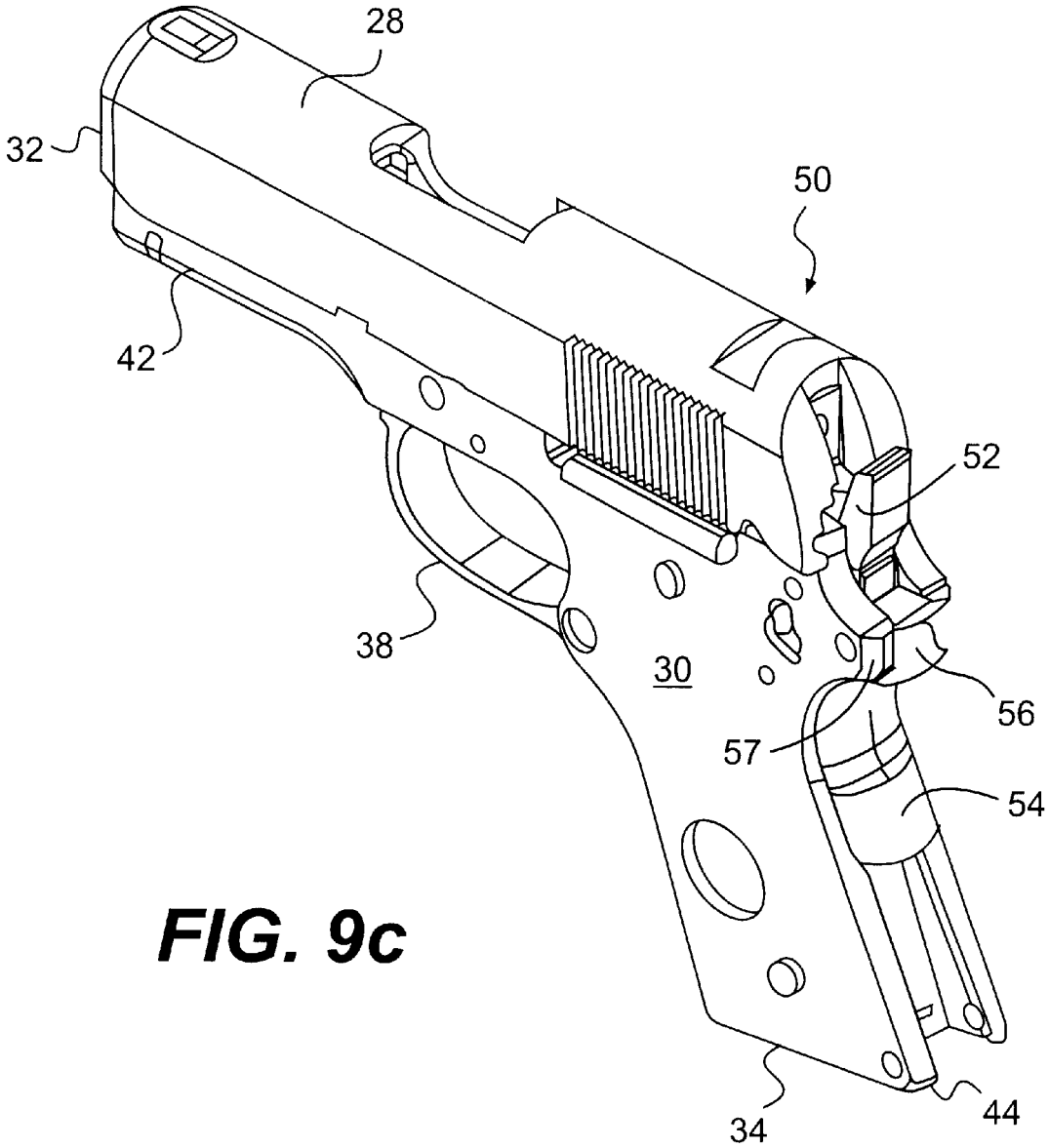
FIG. 9*c* is a perspective view of the handgun of FIG. 9*a,* illustrating the hammer in the half-cocked position
Figure 9D:
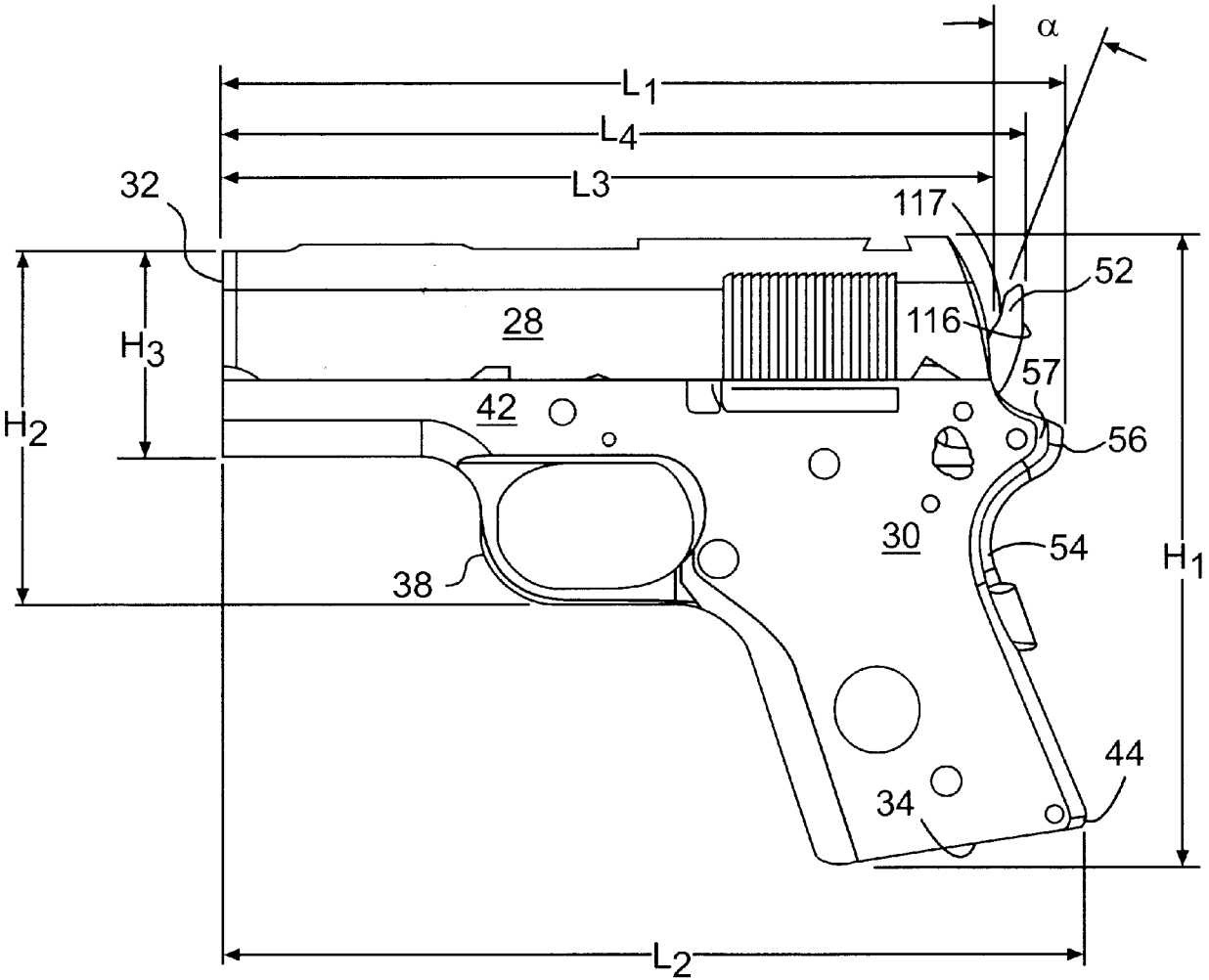
FIG. 9*d* is a side view of the handgun of FIG. 9*a,* illustrating the hammer in a fully cocked position.

Preferably, as illustrated in FIGS. 9*c* and 9*d,* frame 30 includes angled surfaces 57 adjacent to the pivot point of grip safety 54. Angled surfaces 57 are disposed on both sides of frame 30 and are configured to conform to outer surface 56 of grip safety 54. Angled surfaces 57 reduce the likelihood that frame 30 will catch on an article of clothing or a holster when the handgun is withdrawn from its carrying position.

Figure 8A:
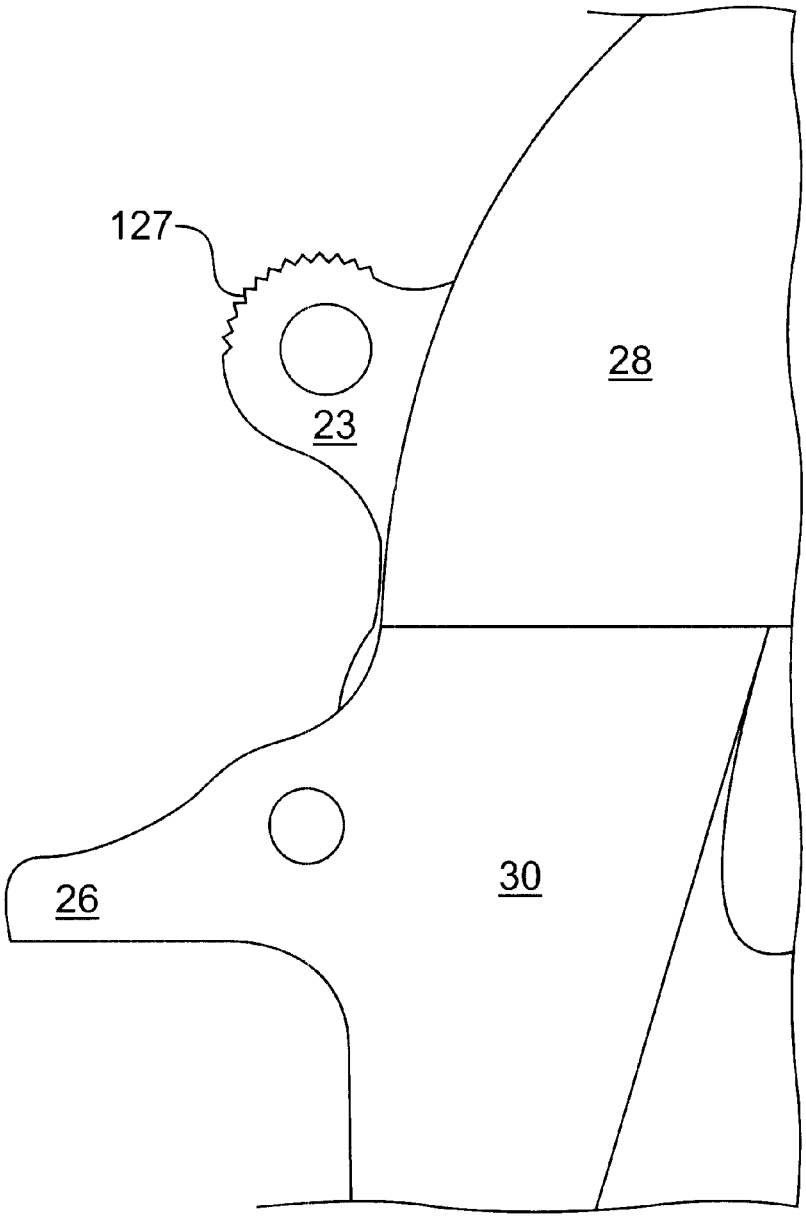
FIG. 8a PRIOR ART
FIG. 8*a* is a side view of a conventional government model handgun, illustrating a hammer in a rest position.
Figure 8B:
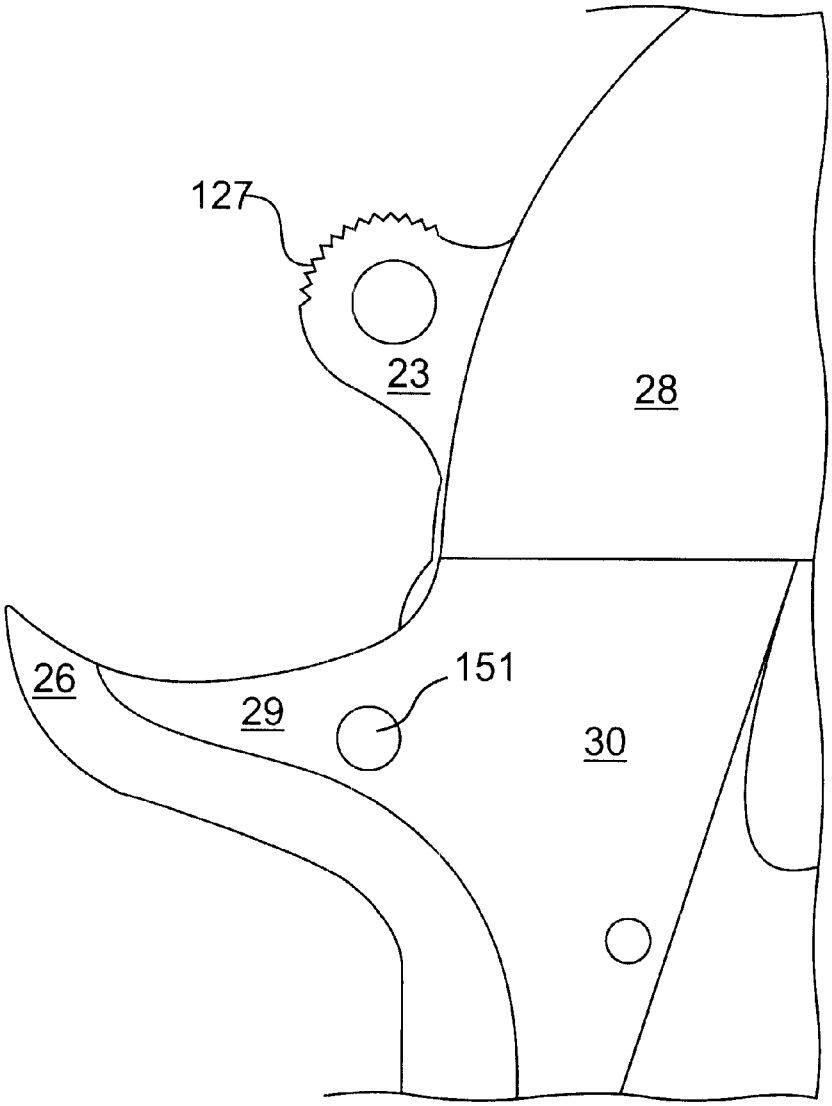
FIG. 8b PRIOR ART
FIG. 8*b* is a side view of another conventional government model handgun, illustrating the hammer in the rest position.

FIGS. 8*a* and 8*b* illustrate conventional government model handgun 20 where hammer 22 is in the uncocked position. As shown in FIG. 8*a,* standard safety ridge 26 extends away from frame 30 and is configured to prevent any portion of the user's hand from approaching spur 23 of the hammer. As shown in FIG. 8*b,* "beaver tail" safety ridge 27 similarly extends away from frame 30. The "beaver tail" safety ridge of FIG. 8*b* extends further than the safety ridge of FIG. 8*a*.

Figure 8C:
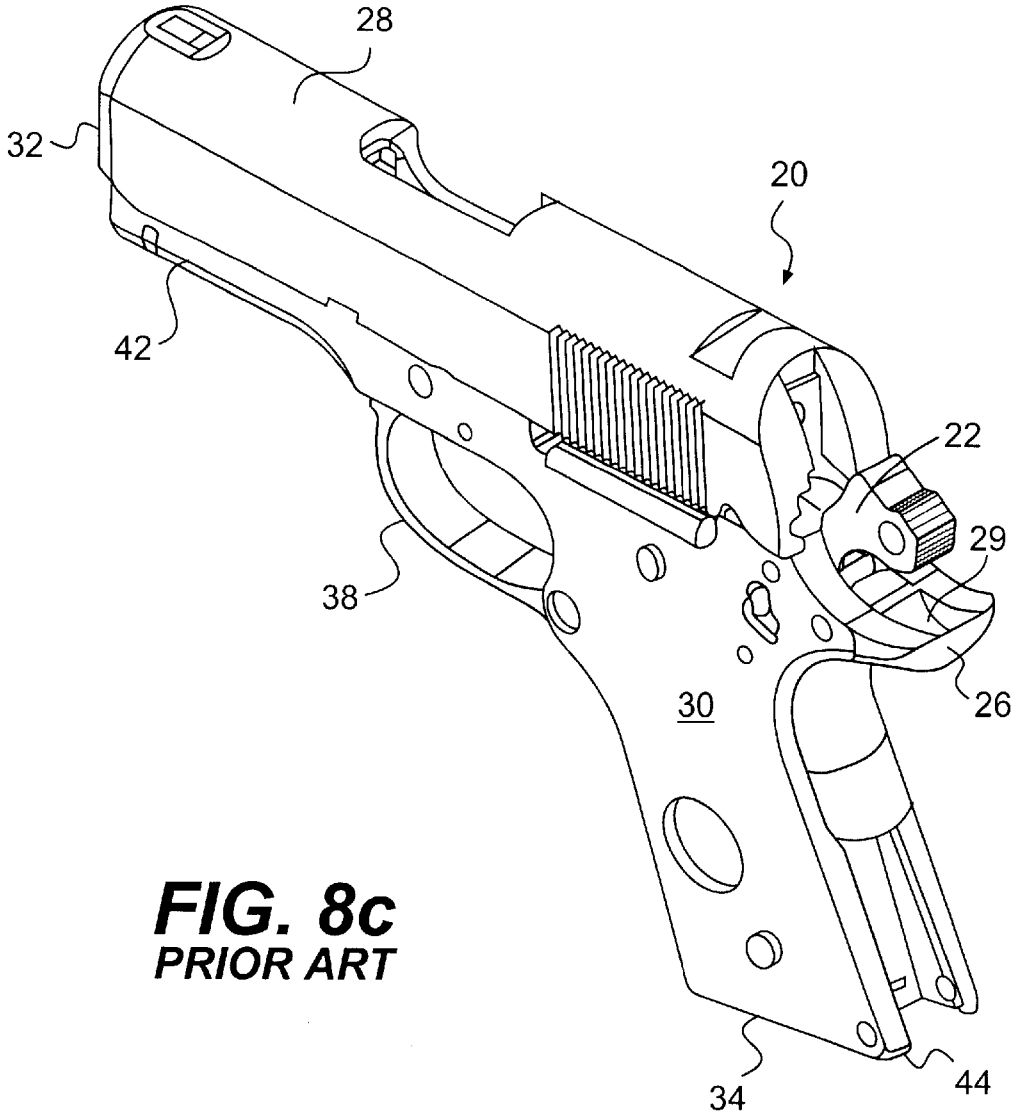
FIG. 8c PRIOR ART
FIG. 8*c* is a perspective view of the handgun of FIG. 8*b* illustrating the hammer in a fully cocked position.
Figure 8D:
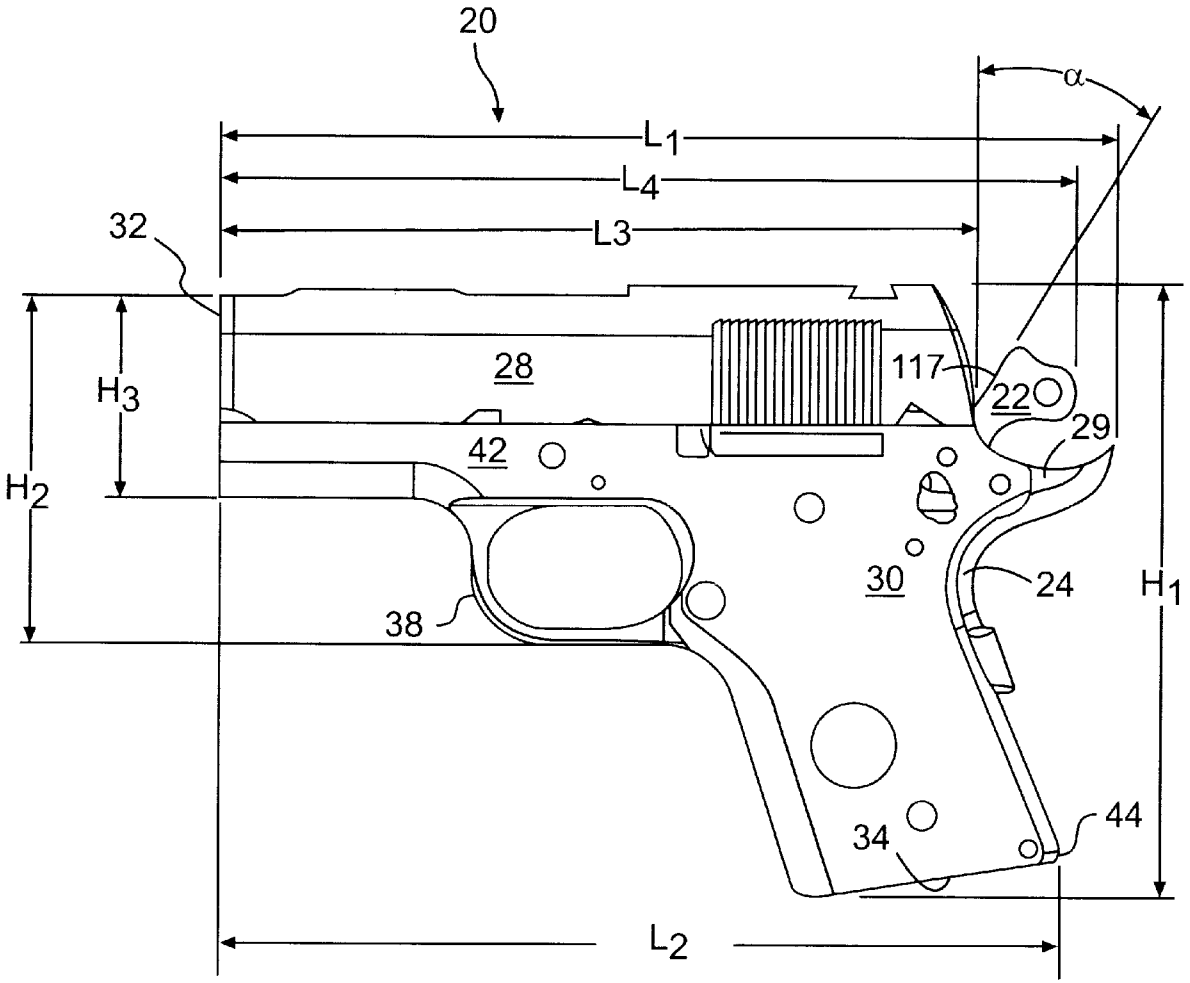
FIG. 8d PRIOR ART
FIG. 8*d* is a side view of the handgun of FIG. 8*b* illustrating the hammer in a fully cocked position.

FIGS. 8*c* and 8*d* illustrate conventional government model handgun 20 where hammer 22 is in the cocked position. As described previously, hammer 22 may be cocked by manually retracting the hammer. To achieve the cocked position, hammer 22 is rotated through an angle $\alpha$ (measured from the vertical) of at least 60°. After hammer is rotated past this angle and released, the hammer spring of the handgun acts on the hammer cam through the strut to rotate the hammer cam into engagement with the sear. From this position, the trigger may be pulled to release the hammer and fire a round of ammunition.

In response to the fired round, the recoil action moves slide 28 rearwardly along slide support 42. Slide 28 engages hammer 22 and retracts hammer 22. Slide 28 moves hammer 22 through angle $\alpha$ of at least 60°. When hammer 22 is in its most rearward position, spur 23 approaches, and may contact, upper surface of grip safety 24. In the "beaver tail" version of grip safety 24 (as illustrated in FIGS. 8*c* and 8*d*), spur 23 enters into opening 29, but does not contact grip safety 24. However, if the user has large hands and any portion of the user's hand is positioned on the top surface of the grip safety when a round is fired, the motion of the hammer will cause spur 23 of hammer 22 to pinch the user's hand. Given the great magnitude of the recoil force, any such pinching of the user's hand can be a very painful experience.

FIGS. 9*a*–9*c* illustrate an embodiment of a compact government model handgun. Preferably, as shown in FIG. 9*a,* when hammer 52 is in the fully uncocked position, the substantial entirety of hammer 52 is disposed within slide 28 such that outer edge 116 of the hammer substantially aligns with a rear end 160 of slide 28. For the purposes of the present disclosure, the term "substantially aligns" is intended to include those hammer and slide configurations wherein the outer shape of the hammer conforms to the outer shape of the slide so that the hammer is not likely to catch on an article passing over the rear of the slide. For example, outer edge 116 may be flush with rear end 160 of slide 28 or outer edge 116 may be slightly inside or outside of rear end 160 of slide 28. In this configuration, it would be difficult for a user to grasp the hammer to cock the hammer. Thus, the hammer may be cocked by either manually retracting the slide or by the automatic retraction of the slide in response to the recoil action of a fired round.

As described previously, the width of hammer 52 may be as much as approximately 0.375 inches less than the width of hammer 22 of a conventional government model. The difference in width translates to a larger gap between outer edge 116 of hammer 52 and the upper surface of grip safety 54 when hammer is in its most rearward position. Accordingly, the likelihood of a user's hand being pinched during the recoil action of the handgun is significantly reduced. Thus, with the present invention, the need for a safety ridge on the grip safety to protect the user's hand is obviated.

As will also be apparent from the foregoing disclosure, the removal of the spur from hammer 22 reduces the mass of hammer 22. During operation of the handgun, the reduction in mass of hammer 22 allows hammer 22 to complete a firing cycle more rapidly than a conventional hammer with a spur and, thus, a larger mass. Accordingly, a handgun having a spurless hammer may fire consecutive shots in a shorter amount of time than a handgun having a conventional hammer.

As illustrated in FIGS. 9*b*, 9*c,* and 9*d,* after hammer 52 is cocked and the slide returns to its forward position, the hammer return spring acts on hammer 52 to move the hammer to its half cocked position. In the half cocked position, hammer 52 rests at an angle $\alpha$ of approximately 0° from vertical.

Because the sizes of the hammer and the grip safety are reduced, a compact version of the government model handgun is provided. Referring to the dimensions identified in FIG. 2*b*, $L_1$ may be approximately 6.13 inches, $L_2$ is approximately 6.36 inches, $L_3$ and $L_4$ may be approximately 5.67 inches, $H_1$ may be approximately 4.65 inches, $H_2$ may be approximately 2.65 inches, and $H_3$ may be approximately 1.53 inches. More preferably, $L_1$ may be approximately 6.123 inches, $L_2$ may be approximately 6.359 inches, $L_3$ and $L_4$ may be approximately 5.667 inches, $H_1$ may be approximately 4.650 inches, $H_2$ may be approximately 2.647 inches, and $H_3$ may be is approximately 1.525 inches.

Thus, by reducing the size of the grip safety the overall length of the handgun is reduced. In the embodiment of the present invention illustrated in FIG. 2*b,* the greatest length of the handgun is indicated by length $L_2$ (distance from barrel tip to rear of grip), whereas the greatest length of the conventional government model handgun as illustrated in FIG. 1*b* is indicated by length $L_1$ (distance from barrel tip to rear of grip safety). This results in an overall reduction in length of approximately 0.35 inches between the conventional government model handgun with a beaver tail type grip safety and a government model handgun according to an embodiment of the present invention. It is also noted that the length of the handgun at the area of the grip safety (indicated by length $L_2$) is reduced by approximately 0.59 inches between the conventional government model handgun with a beaver tail type grip safety and a handgun according to an embodiment of the present invention.

In addition, the number and size of projections in the area of the hammer is reduced, i.e. the hammer spur and the grip safety. This reduces the likelihood that the either the hammer or the grip safety will catch on a holster or another article of clothing when a user draws the handgun from its storage location.

It is contemplated that the reduced size of the grip safety provides for a smaller overall grip length. Because the danger of the hammer pinching a user's hand is removed, the grip of the handgun need not be as long as the grip of a conventional government model handgun. Thus, the length of the grip of the handgun may also be reduced, which translates to a reduction in the overall height, $H_1$, of the handgun. Accordingly, a smaller magazine, such as a six-round magazine, instead of the more typical seven-round magazine, may be used. This will further reduce the overall size of the handgun.

It will be apparent to those skilled in the art that various modifications and variations can be made in the construction of this compact government model semi-automatic handgun without departing from the scope or spirit of the invention. Other embodiments of the invention will be apparent to those skilled in the art from consideration of the specification and practice of the invention disclosed herein.

What is claimed is:

1. A semi-automatic handgun, comprising:

a frame;

a slide having a front side and a back side, the slide mounted on the frame for sliding movement between a forward position and a backward position;

a hammer mounted on the frame for pivoting movement between a rest position and a rearward position, the hammer having a rear outer surface configured to substantially align with the back side of the slide when the slide is in the forward position and the hammer is in the rest position; and a grip safety disposed in the frame, the grip safety having a safe position where the grip safety prevents the hammer from moving.

2. The semi-automatic handgun of claim 1, wherein the grip safety has a firing position where the grip safety does not interfere with the movement of the hammer.

3. The semi-automatic handgun of claim 1, further comprising a barrel having a tip and wherein the frame includes a rear end, the grip safety includes an outer surface, and a first length of the handgun as defined by the barrel tip and the rear end of the frame is greater than a second length of the handgun as defined by the barrel tip and the outer surface of the grip safety.

4. The semi-automatic handgun of claim 3, wherein the first length of the handgun as defined by the barrel tip and the rear end of the frame is approximately 6.36 inches and the second length of the handgun as defined by the barrel tip and the outer surface of the grip safety is approximately 6.12 inches.

5. The semi-automatic handgun of claim 4, wherein the frame has a bottom, the slide has a top and a height of the handgun as defined by the bottom of the frame and the top of the slide is approximately 4.65 inches.

6. The semi-automatic handgun of claim 1, wherein the hammer includes a grip safety notch and the grip safety includes a hammer engagement configured to engage the grip safety notch to prevent the hammer from moving.

7. The semi-automatic handgun of claim 1, wherein the hammer has a firing section connected to a first side support and a second side support and a greatest width of the firing section is located where the firing section is connected to the first and second side supports.

8. The semi-automatic handgun of claim 7, wherein the greatest width of the firing section is approximately 0.30 inches.

9. A semi-automatic handgun, comprising:

a frame having a rear end;

a barrel having a tip;

a slide having a front side and a back side, the slide mounted on the frame for sliding movement between a forward position and a backward position;

a hammer mounted on the frame for pivoting movement between a rest position and a rearward position, the hammer having a rear outer surface configured to substantially/ align with the back side of the slide when the slide is in the forward position and the hammer is in the rest position; and a grip safety having an outer surface disposed in the frame, the grip safety having a safe position where the grip safety prevents the hammer from moving, wherein a first length of the handgun as defined by the barrel tip and the rear end of the frame is greater than a second length of the handgun as defined by the barrel tip and the outer surface of the grip safety.

10. The semi-automatic handgun of claim 9, wherein the grip safety has a firing position where the grip safety does not interfere with the movement of the hammer.

11. The semi-automatic handgun of claim 9, wherein the first length of the handgun as defined by the barrel tip and the rear end of the frame is approximately 6.36 inches and the second length of the handgun as defined by the barrel tip and the outer surface of the grip safety is approximately 6.12 inches.

12. The semi-automatic handgun of claim 9, wherein the frame has a bottom, the slide has a top, and a height of the handgun as defined by the bottom of the frame and the top of the slide is approximately 4.65 inches.

13. The semi-automatic handgun of claim 9, wherein the hammer includes a grip safety notch and the grip safety includes a hammer engagement configured to engage the grip safety notch to prevent the hammer from moving.

14. The semi-automatic handgun of claim 9, wherein the hammer has a firing section connected to a first side support and a second side support and a greatest width of the firing section is located where the firing section is connected to the first and second side supports.

15. The semi-automatic handgun of claim 14, wherein the greatest width of the firing section is approximately 0.30 inches.

16. A semi-automatic handgun, comprising:

a frame having a rear end;

a barrel having a tip;

a slide having a front side and a back side, the slide mounted on the frame for sliding movement between a forward position and a backward position;

a hammer mounted on the frame for pivoting movement between a rest position and a rearward position; and a grip safety disposed in the frame and having an outer surface, the grip safety having a safe position where the grip safety engages the hammer to prevent the hammer from pivoting from the rest position to the rearward position, wherein a first length of the handgun as defined by the barrel tip and the rear end of the frame is greater than a second length of the handgun as defined by the barrel tip and the outer surface of the grip safety.

17. The semi-automatic handgun of claim 16, wherein the first length of the handgun as defined by the barrel tip and the rear end of the frame is approximately 6.36 inches and the second length of the handgun as defined by the barrel tip and the outer surface of the grip safety is approximately 6.12 inches.

18. The semi-automatic handgun of claim 17, wherein the frame has a bottom, the slide has a top, and a height of the handgun as defined by the bottom of the frame and the top of the slide is approximately 4.65 inches.

19. The semi-automatic handgun of claim 16, wherein the grip safety has a firing position where the grip safety does not interfere with the movement of the hammer.

20. The semi-automatic handgun of claim 16, wherein the hammer has an outer surface configured to substantially align with the back side of the slide when the slide is in the forward position and the hammer is in the rest position.

21. The semi-automatic handgun of claim 16, wherein the hammer includes a grip safety notch and the grip safety includes a hammer engagement configured to engage the grip safety notch to prevent the hammer from moving.

22. The semi-automatic handgun of claim 16, wherein the hammer has a firing section connected to a first side support and a second side support and a greatest width of the firing section is located where the firing section is connected to the first and second side supports.

23. The semi-automatic handgun of claim 22, wherein the greatest width of the firing section is approximately 0.30 inches.

24. A method of manufacturing a semi-automatic handgun, comprising:

providing a frame having a rear end;

mounting a slide having a front side and a back side on the frame for sliding movement between a forward position and a backward position;

mounting a hammer on the frame for pivoting movement between a rest position and a rearward position, the hammer having a rear outer surface configured to substantially align with the back side of the slide when the slide is in the forward position and the hammer is in the rest position; and disposing a grip safety having an outer surface in the frame, the grip safety operable to selectively engage the hammer to prevent the hammer from moving.

25. The method of claim 24, further comprising the step of disposing a barrel having a tip on the frame, wherein a first length of the handgun as defined by the barrel tip and the rear end of the frame is greater than a second length of the handgun as defined by the barrel tip and the outer surface of the grip safety.

26. A method of manufacturing a semi-automatic handgun, comprising:

providing a frame having a rear end;

disposing a barrel having a tip on the frame;

mounting a hammer on the frame for pivoting movement between a rest position and a rearward position;

mounting a slide having a front side and a back side on the frame for sliding movement between a forward position and a backward position; and disposing a grip safety having an outer surface in the frame, the grip safety operable to selectively prevent the hammer from pivoting from the rest position to the rearward position, wherein a first length of the handgun as defined by the barrel tip and the rear end of the frame is greater than a second length of the handgun as defined by the barrel tip and the outer surface of the grip safety.

27. The method of claim 26, wherein the hammer has an outer surface configured to substantially align with the back side of the slide when the slide is in the forward position and the hammer is in the rest position.

28. A method of manufacturing a semi-automatic handgun, comprising:

providing a frame having a rear end;

disposing a barrel having a tip on the frame;

forming a slide having a front side and a back side;

mounting a hammer on the frame for pivoting movement between a rest position and a rearward position;

mounting the slide on the frame for sliding movement between a forward position and a backward position; and disposing a grip safety having an outer surface in the frame, the grip safety operable to selectively prevent the hammer from pivoting from the rest position to the rearward position, wherein a first length of the handgun as defined by the barrel tip and the rear end of the frame is greater than a second length of the handgun as defined by the barrel tip and the outer surface of the grip safety.

29. The method of claim 28, wherein the hammer has an outer surface configured to substantially align with the back side of the slide when the slide is in the forward position and the hammer is in the rest position.

30. A method of manufacturing a semi-automatic handgun, comprising:

providing a frame having a rear end;

mounting a slide having a front side and a back side on the frame for sliding movement between a forward position and a backward position;

forming a hammer having a rear outer surface;

mounting the hammer on the frame for pivoting movement between a rest position and a rearward position such that the rear outer surface of the hammer substantially aligns with the back side of the slide when the slide is in the forward position and the hammer is in the rest position; and disposing a grip safety having an outer surface in the frame, the grip safety operable to selectively engage the hammer to prevent the hammer from moving.

31. The method of claim 30, further comprising the step of disposing a barrel having a tip on the frame, wherein a first length of the handgun as defined by the barrel tip and the rear end of the frame is greater than a second length of the handgun as defined by the barrel tip and the outer surface of the grip safety.

32. A semi-automatic handgun, comprising:

a frame having an outer surface and a rear end;

a slide having a front side and a back side, the slide mounted on the frame for sliding movement between a forward position and a backward position;

a hammer mounted on the frame for pivoting movement between a rest position and a rearward position, the hammer having a rear outer surface configured to substantially align with the back side of the slide when the slide is in the forward position and the hammer is in the rest position; and a grip safety disposed in the frame and having an outer surface that substantially conforms to the outer surface of the frame, the grip safety selectively operable to engage the hammer and prevent the hammer from moving.

33. The semi-automatic handgun of claim 32, further comprising a barrel having a tip and wherein a first length of the handgun as defined by the barrel tip and the rear end of the frame is greater than a second length of the handgun as defined by the barrel tip and the outer surface of the grip safety.

34. The semi-automatic handgun of claim 33, wherein the first length of the handgun as defined by the barrel tip and the rear end of the frame is approximately 6.36 inches and the second length of the handgun as defined by the barrel tip and the outer surface of the grip safety is approximately 6.12 inches.

35. The semi-automatic handgun of claim 34, wherein the frame has a bottom, the slide has a top, and a height of the handgun as defined by the bottom of the frame and the top of the slide is approximately 4.65 inches.

36. The semi-automatic handgun of claim 32, wherein the hammer has a firing section connected to a first side support and a second side support and a greatest width of the firing section is approximately 0.30 inches.

37. A semi-automatic handgun, comprising:

a frame having an outer surface, a rear end, and a bottom;

a barrel having a tip;

a slide having a front side, a back side and a top, the slide mounted on the frame for sliding movement between a forward position and a backward position;

a hammer mounted on the frame for pivoting movement between a rest position and a rearward position, the hammer having a rear outer surface configured to substantially align with the back side of the slide when the slide is in the forward position and the hammer is in the rest position; and a grip safety disposed in the frame and having an outer surface that substantially conforms to the outer surface of the frame, the grip safety selectively operable to engage the hammer and prevent the hammer from moving;

wherein a first length of the handgun as defined by the barrel tip and the rear end of the frame is approximately 6.36 inches, a second length of the handgun as defined by the barrel tip and the outer surface of the grip safety is approximately 6.12 inches, and a height of the handgun as defined by the bottom of the frame and the top of the slide is approximately 4.65 inches.

38. The semi-automatic handgun of claim 37, wherein the hammer has a firing section connected to a first side support and a second side support and a greatest width of the firing section is approximately 0.30 inches.

39. A semi-automatic handgun, comprising:

a frame having an outer surface;

a slide having a front side and a back side, the slide mounted on the frame for sliding movement between a forward position and a backward position;

a hammer mounted on the frame for pivoting movement between a rest position and a rearward position, the hammer having a rear outer surface configured to substantially align with the back side of the slide when the slide is in the forward position and the hammer is in the rest position;

a hammer cam rotatably disposed in the frame and selectively engageable with the hammer; and a grip safety disposed in the frame and having an outer surface that substantially conforms to the outer surface of the frame, the grip safety selectively operable to engage the hammer and prevent the hammer from moving.

40. The semi-automatic handgun of claim 39, further comprising a barrel having a tip and wherein the frame includes a rear end, the grip safety includes an outer surface, and a first length of the handgun as defined by the barrel tip and the rear end of the frame is greater than a second length of the handgun as defined by the barrel tip and the outer surface of the grip safety.

41. The semi-automatic handgun of claim 40, wherein the first length of the handgun as defined by the barrel tip and the rear end of the frame is approximately 6.36 inches and the second length of the handgun as defined by the barrel tip and the outer surface of the grip safety is approximately 6.12 inches.

42. The semi-automatic handgun of claim 41, wherein the frame has a bottom, the slide has a top and a height of the handgun as defined by the bottom of the frame and the top of the slide is approximately 4.65 inches.

43. The semi-automatic handgun of claim 39, wherein the hammer has a firing section connected to a first side support and a second side support and a greatest width of the firing section is located where the firing section is connected to the first and second side supports.

44. The semi-automatic handgun of claim 43, wherein the greatest width of the firing section is approximately 0.30 inches.

* * * * *

UNITED STATES PATENT AND TRADEMARK OFFICE

CERTIFICATE OF CORRECTION

PATENT NO. : 6,557,288 B2
DATED : May 6, 2003
INVENTOR(S) : Atilla Szabo

It is certified that error appears in the above-identified patent and that said Letters Patent is hereby corrected as shown below:

Title page,
Item [76], Inventor, Attila Szabo" should read -- Atilla Szabo --.

Column 11,
Line 36, "substantially/ align" should read -- substantially align --.

Signed and Sealed this

Eighth Day of July, 2003

JAMES E. ROGAN
*Director of the United States Patent and Trademark Office*